US007681693B2

(12) United States Patent
Tegtmeier et al.

(10) Patent No.: US 7,681,693 B2
(45) Date of Patent: Mar. 23, 2010

(54) METHOD FOR PERFORMING AN ELEVATOR RESCUE RUN

(75) Inventors: Dirk Heinrich Tegtmeier, Berlin (DE); Herbert Karl Horbruegger, Berlin (DE); Michael Mann, Berlin (DE); Kristian Bernhard Wittjen, Teltow (DE)

(73) Assignee: Otis Elevator Company, Farmington, CT (US)

( * ) Notice: Subject to any disclaimer, the term of this patent is extended or adjusted under 35 U.S.C. 154(b) by 500 days.

(21) Appl. No.: 11/813,238

(22) PCT Filed: Jan. 11, 2005

(86) PCT No.: PCT/EP2005/000175

§ 371 (c)(1),
(2), (4) Date: Jul. 2, 2007

(87) PCT Pub. No.: WO2006/074689

PCT Pub. Date: Jul. 20, 2006

(65) Prior Publication Data

US 2008/0202859 A1 Aug. 28, 2008

Related U.S. Application Data

(63) Continuation-in-part of application No. 10/575,024, filed as application No. PCT/EP03/11093 on Oct. 7, 2003, now Pat. No. 7,549,515.

(51) Int. Cl.
*B66B 1/32* (2006.01)

(52) U.S. Cl. ..... 187/288; 187/290; 187/291

(58) Field of Classification Search ..... 187/247, 187/248, 313, 284, 288–291, 296, 297, 391–393; 307/66, 68, 69

See application file for complete search history.

(56) References Cited

U.S. PATENT DOCUMENTS

| | | | | |
|---|---|---|---|---|
| 3,961,688 | A * | 6/1976 | Maynard | 187/289 |
| 4,441,584 | A * | 4/1984 | Mitsui et al. | 187/296 |
| 5,698,823 | A * | 12/1997 | Tanahashi | 187/296 |
| 5,945,644 | A * | 8/1999 | Jang | 187/296 |
| 7,549,515 | B2 * | 6/2009 | Tegtmeier et al. | 187/288 |
| 2008/0185233 | A1 * | 8/2008 | Tegtmeier et al. | 187/290 |

(Continued)

FOREIGN PATENT DOCUMENTS

EP 0733578 B1 6/2002

(Continued)

*Primary Examiner*—Jonathan Salata
(74) *Attorney, Agent, or Firm*—Carlson, Gaskey & Olds PC

(57) ABSTRACT

Method for performing an elevator rescue run in an emergency situation, the elevator comprising and elevator car, a counter weight, a rope suspending the car and the counterweight, a drive motor, an emergency brake for stopping the car in an emergency situation, and a motor drive unit for supplying drive power to and for controlling the drive motor, having the following rescue run sequence steps:

(a) operating the motor drive unit in a zero speed demand mode for holding the car at its present position;

(b) lifting the brake, while holding the car in the zero speed demand mode;

(c) determining the preferred movement direction of the car based on the power data as obtained by the motor drive unit; and (d) performing the rescue run in the direction of the determined preferred movement direction.

16 Claims, 2 Drawing Sheets

U.S. PATENT DOCUMENTS

2008/0264729 A1* 10/2008 Mustalahti et al. ..... 187/288
2009/0127029 A1* 5/2009 Oesterle et al. ..... 187/290

FOREIGN PATENT DOCUMENTS

EP 0733577 B1 9/2003
JP 04169487 A * 6/1992
JP 11212650 8/1999
WO 9828229 6/1999

* cited by examiner

METHOD FOR PERFORMING AN ELEVATOR RESCUE RUN

CROSS REFERENCE TO RELATED APPLICATIONS

This application is the national phase application of International Application No. PCT/EP2005/000175, filed 11 Jan., 2005, and is a continuation-in-part of U.S. application Ser. No. 10/575,024, which is the national stage application of the PCT Application No. PCT/EP03/11093, which was filed on Oct. 7, 2003, now U.S. Pat. No. 7,549,515.

BACKGROUND OF THE INVENTION

The present invention relates to a method for performing an elevator rescue run in an emergency situation, the elevator comprising an elevator car, a counterweight, a rope suspending the car and the counterweight, a drive motor, an emergency brake for stopping the car in an emergency situation and a motor drive unit for supplying drive power to and for controlling the drive motor, as well as a corresponding elevator.

For safety reasons elevators are constructed so as to immediately stop the the car in an emergency situation during its travel in the elevator shaft. Practically, power to the drive motor and the emergency brake is interrupted, causing the drive motor to stop driving the car and causing the emergency brake to fall in and to stop the car almost immediately. Since such stopping will normally not occur at a landing, but randomly at any location within the elevator shaft, passengers will get trapped in the elevator car. In such an emergency situation it is mandatory to free the passengers from the elevator car as soon as possible. This requires the presence of a technician or qualified personnel at the elevator site and it may take some time before such qualified person arrives.

In most cases the emergency situation is caused by a power failure in the main power supply to the elevator. Emergency situations may also be caused by defects in the elevator itself, for example an interruption of the safety chain, with the elevator control, the encoder, etc. While after a power failure the elevator takes up operation once power is again available, other situations require the presence of a qualified person as mentioned above.

There are two different emergency situations, i.e. an emergency situation in which car and counterweight are in an unbalanced condition, i.e. once the brake is lifted, the car starts moving by gravity. U.S. Pat. No. 6,196,355 B1 discloses an electrical elevator rescue system for freeing the passengers in this kind of situation. However, there also is the balanced load condition, i.e. even after lifting the brake the car will remain at its position. Due to the fact that normally elevators are designed to be in a balanced condition for the most common operational conditions, such a balanced load condition is not uncommon.

U.S. Pat. No. 5,821,476 teaches a carry-along emergency device including an emergency DC power supply, a switching device for alternatively feeding DC voltage for windings of the drive motor and an actuator for releasing the elevator brake. The switching device typically is a rotary switch having 6 contacts which are connected to the windings of the drive motor so that in the course of rotating the switch from one contact to the next contact the windings of the elevator motor are successively energized, thus advancing the car and the counterweight step by step.

Another approach for moving the elevator car in a balanced load condition is described in EP 0 733 577 A2, which suggests to provide a separate rescue drive means for moving the car in a balanced load condition.

The problem with any such construction resides in the fact that the respective methods of operation require the presence of a technician or a qualified person at the elevator site. Particularly, once such qualified person arrives at the elevator, he has to control the rescue run from a service panel board. The typical rescue operation is different for the balanced load condition and the unbalanced load condition. At the beginning, while monitoring the movement of the car, the technician will lift the emergency brake. To this effect normally the service panel board is typically provided with a "brake release button". The technician will actuate the brake release button and, if the car is in an unbalanced load condition, the car will start moving. The technician will use the emergency brake for stopping the car, once the car has accelerated to a certain speed. By repeatedly opening and closing the emergency brake ("stutter braking"), due to gravity the car will move to an appropriate landing where the passengers may leave the car. If the car is in a balanced load condition, the car will not move, once the brake has been opened. In such a situation motive force to the car may be provided for example by the apparatus as described in U.S. Pat. No. 5,821,476 or U.S. Pat. No. 4,376,471.

The respective methods for performing the elevator rescue run of the prior art are complicated and require particular skills in for being performed.

It is therefore an object of the present invention to provide a method for performing an elevator rescue run which is simple and reliable.

SUMMARY OF THE INVENTION

In accordance with an embodiment of the present invention such object is solved with a method for performing an elevator rescue run comprising the following rescue run sequence steps:

(a) operating the motor drive unit in a zero speed demand mode for holding the car at its present position;

(b) lifting the brake while holding the car in the zero speed demand mode;

(c) determining the preferred movement direction of the car based on the power data as obtained by the motor drive unit; and (d) performing the rescue run in the direction of the determined preferred movement direction.

With such method, once the elevator car has been stopped as usual in the elevator shaft in an emergency situation, the brake is not just opened while the motor drive unit monitors movement thereof. In order to have an absolutely controlled condition of the elevator car, the motor drive unit is operated in a zero speed demand mode, i.e. an operational mode in which the motor drive unit controls the drive motor so as to hold the elevator car in the elevator shaft at its current position. While holding the car in the zero speed demand mode at its position and after lifting the brake or on the basis of information previously obtained the motor drive unit can determine whether the car is in a balanced load or in an unbalanced load condition and can further determine its preferred movement direction. On the basis of such information the rescue run is performed in the direction of the determined preferred movement direction. The motor drive may actively control the acceleration of the car, i.e. with a pre-determined rate, to the desired rescue run speed, independent of whether the car starts moving on its own or requires an external motive force.

Preferably, the method comprises the step of supplying power from the emergency power supply to the motor drive unit. This is particularly required in case of a power failure. As the emergency power supply is generally of limited capacity, it is particularly important to consume power economically. A substantial portion of the power is spent for actively moving the elevator car if it is not moving by itself. It has to be noted that even if the car is in the so-called "balanced condition", i.e. if the car is not moving even though the emergency brake has been lifted, the car and the counterweight are not in a perfectly balanced condition, but friction in the system, etc. keeps it from moving on its own. Consequently, even in the "balanced load condition" typically a preferred movement direction of the car exists. Accordingly, a movement in a direction opposite to the preferred movement direction will consume substantially more power than necessary. The present embodiment of the invention allows to determine such preferred movement direction of the elevator car on the basis of power data as obtained by the motor drive unit while holding the car in the zero speed demand mode and/or based on data as obtained during the normal operation run just before the emergency situation. Consequently, the consumption of power particularly from the emergency power supply can substantially be reduced with this embodiment of the present invention.

Preferably, the motor drive unit controls the performance of the rescue run. Particularly, after the preferred movement direction of the car has been determined by the motor drive unit, the operational mode thereof can be changed from zero speed demand mode to a rescue demand allowing the car to move towards an appropriate landing due to gravity or actively moving the car to such landing. Preferably, generator power as produced by the drive motor and transmitted to the motor drive unit and/or drive power which is supplied from the motor drive unit to the drive motor is used for calculating the actual position, movement direction, speed, and/or acceleration of the car. On the basis of such data the speed of the car can be accelerated or be reduced.

Preferably, the motor drive unit activates the emergency brake to open after the zero speed demand operation has been established. Alternatively, the emergency brake may be manually opened, for example with a switch on the service panel board. Having the motor drive unit activate the emergency brake reduces the steps to be manually performed and facilitates to automatically perform a rescue run.

Preferably, the motor drive unit activates the performance of the rescue run, once the preferred movement direction of the car has been determined. Again, such activation can also be manually performed. The shorter the delay between the completion of the determination of the preferred movement direction and the activation of the rescue run performance rescue run the less power is consumed.

Preferably, the rescue run sequence is automatically started, once an emergency situation is detected. Such an automatic start of the rescue run sequence has the distinct advantage of freeing the passengers within a very short time. It can be preferred not to automatically start a rescue run sequence with particular emergency situations, for example in case of a failure of the motor drive unit. In this kind of situation it may be preferred to perform a rescue run only while a technician etc. is present at the elevator site.

Preferably, the method for performing a rescue run includes the further step of surveying the presence of main power supply to the elevator and to automatically start the rescue run sequence once the main power failure has been detected. In order to have well defined conditions during the rescue run and in order to avoid any disturbance by sudden discovery of the main supply, a further step of interrupting the main power supply to the motor drive unit at least for the interval between the start of the rescue run sequence and until its completion can be provided.

Preferably, the motor drive unit supplies power from the emergency power supply to the drive motor during the step of performing the rescue run. Thus the actual drive motor is moving the elevator car in a balanced load condition during the rescue run. Alternatively, the elevator comprises a separate rescue drive means which is separate from the drive motor. The motor drive unit can activate said rescue drive means once the preferred movement direction of the car has been determined. It is also possible to start the rescue drive means manually.

An embodiment of the present invention also relates to an elevator comprising an elevator car, a counterweight, a rope suspending the car and the counterweight, a drive motor, an emergency brake for stopping the car in an emergency situation, and a motor drive unit for supplying drive power to and for controlling the drive motor, wherein the motor drive unit is adapted to operate in a zero speed demand mode for holding the car at a particular position and to determine the preferred movement direction of the car based on the power data as obtained by the motor drive unit while holding the car in the zero speed demand mode, and wherein the elevator further comprises a means for setting the motor drive unit into the zero speed demand mode in case of an emergency situation in preparation of a rescue run and for subsequently activating performance of the rescue run in the direction of the determined preferred movement direction. The preferred movement direction of the car can be determined based on the power data as obtained by the motor drive unit while holding the car in the zero speed demand mode and/or based on power data as obtained by the motor drive unit during the last run of the car before the emergency situation occurred.

Preferably, the elevator comprises an emergency power supply.

Preferably, the elevator further comprises a means for detecting an emergency situation and preferably also a means for automatically starting a rescue run sequence once an emergency situation has been detected. The detecting means can be part of the motor drive unit. For example the motor drive unit can include a detection means for detecting the interruption the power supply to the motor drive unit. The motor drive unit can also include the means for automatically starting a rescue run sequence. To this effect the motor drive means can include any kind of buffer power storage like an accumulator or a capacitor for storing pre-emergency situation data and for starting the rescue mode during which power may be supplied from the emergency power supply. The detecting means can be a main power surveying means surveying the supply of main power to the elevator and particularly to the elevator control. The elevator may further comprise a main power interrupting means couple to the main power surveying means.

The elevator may comprise a rescue drive means separate from the drive motor. The elevator may further comprise an emergency drive switch for connecting and disconnecting the power from the emergency power supply to the drive motor in order to move the car in a "balanced" emergency situation. The elevator rescue system may further comprise a power line connecting the emergency power supply with the motor drive unit and including the emergency drive switch.

Thus the present invention uses the motor drive unit which is already present in the elevator for supplying the emergency power to the drive motor. The motor drive unit typically has an input for the AC main power supply, a rectifier, a DC intermediate circuit and a converter. The emergency power supply line can either be connected to the AC input or the DC intermediate circuit, depending on the particular motor drive unit. The converter may either be of the VF inverter type (variable frequency inverter) or of the VVVF inverter type (variable voltage variable frequency inverter). By using the conventional motor drive unit of the elevator the number of additional parts of the elevator rescue system can be reduced.

The switches can either be conventional switches or can also comprise any other type of switching means, i.e. may form part of a microprocessor control. Particularly, the emergency drive switch means can be integral with the motor drive unit. It can be designed so as to automatically switch to the emergency power supply in all or specific failure situations.

Preferably, the emergency power supply provides at least two different output voltages, wherein the brake is connected via the emergency brake switch to the lower voltage output and wherein the higher voltage output is connected to the motor drive unit.

Preferably, the emergency power supply comprises a storage battery and a voltage booster for increasing the output voltage of the battery. The emergency power supply can further include a battery loading circuit and a supervisor which is connected to the main power supply. The voltage booster can be a conventional converter for converting the battery voltage to a higher voltage to be supplied to the motor drive unit. In normal operation a conventional motor drive unit receives an AC voltage in the order of 380 V. However, the voltage required for driving the elevator car in a balanced load situation is by far less than the required voltage for normal operation. Accordingly, particularly with a VVVF inverter type the drive motor substantially requires lower voltages for emergency operation. On the other hand, the motor drive unit circuit may require a certain input voltage independent from the particularly output voltage. Therefore the higher output voltage of the emergency power supply should be at least approximately 250 V, preferably 300 V, more preferred 320 V, and most preferred at least approximately 350 V. Accordingly, the higher voltage may be different depending on the normal voltage required by the drive motor and the motor drive unit circuit, respectively. The lower voltage needs to be sufficient for lifting the brake. However, as the brake is preferably connected with the speed control even in the emergency mode, the lower voltage should preferably be high enough to be used as the input voltage for the speed control circuit. A typical voltage is approximately 24 V. The DC battery of the emergency power supply can have a nominal voltage of 12 V or 24 V. However, even in case of a 24 V battery, it is preferred to use a booster circuit also for emitting the lower voltage from the emergency power supply in order to guarantee a constant voltage output.

Alternatively, it is also possible to use an emergency power supply without a voltage booster, if the battery voltage is high enough to supply the voltage for lifting the brake, the voltage for the electric control devices and the voltage of the motor drive unit. There are motor drive units which require a voltage of 48 V only, so that a storage battery supply 48 V suffices. It might be preferred that a voltage reduction means, like a voltage divider, etc. is provided for in the emergency power supply in order to supply a lower voltage, for example 24 V and/or 12 V instead of the 48 V in order to supply the required voltage to the emergency brake and/or the electric control devices.

Preferably, the emergency brake and the motor drive unit are coupled with each other in a way which allows energizing of the drive motor only if the brake is energized. Such a coupling guarantees that the brake is lifted in advance of supplying power to the drive motor. This can be done for example by coupling the respective switches either mechanically or electrically. A particularly simple construction is the positioning of the emergency brake switch with respect to the emergency drive switch so that it is impossible to switch the emergency drive switch before the emergency brake switch has been switched. The person skilled in the art will be able to implement such a solution. Coupling of the switches is an easy mechanical solution. However any other implementation which assures lifting of the brake in advance of supplying power to the drive motor can be used.

Preferably, the brake and the motor drive unit are coupled with each other in a way which allows energizing of the brake only if the motor drive unit is energized. Preferably, the coupling is such that the brake is energized only if the motor drive unit is in an operational mode. Energizing of the motor drive unit in advance of the brake guarantees that the motor drive unit can control the movement of the car once the brake is lifted. There exist motor drive units which can monitor the movement of the car very closely. Thus, such a motor drive unit can monitor as to whether the car starts moving after the brake has been lifted or whether the car is in a balance load situation. Such a motor drive unit can also control the speed of the moving car and activate the brake in order to avoid any overspeed situation. Moreover, the motor drive unit may also include a data storage medium which includes data of the elevator system of just before the failure occurred, i.e. data like current and voltages supplied to the motor which are related with the load situation of the car, the position of the car on its path, like the distance to the next landings, etc. For example this memory can be an EEPROM or the like. The motor drive unit can use such data for making a decision on how to operate the car in the emergency situation, i.e. moving the car by gravity, powering the drive motor for moving the car, in which direction to move the car, etc. Again this coupling can be achieved by a mechanical or electrical coupling.

It is also possible to energize brake and motor drive unit at the same or about the same time.

Preferably, the elevator further comprises a main power switch for disconnecting the main power supply to the elevator, wherein the emergency brake and/or the emergency drive switches are coupled with the main power switch in a way which allows energizing of the brake and/or the drive motor, respectively, only if the main power supply is disconnected. Again, the coupling of the switches can be realized as mentioned before. It is preferred to disconnect the main power supply before starting a rescue operation for safety reasons. Thus the emergency operation can be stopped in a controlled way, before the main power is connected to the elevator again. Without such a feature an unsecured or undefined condition can occur if during a rescue operation the main power will terminate, and the main power will be supplied to the elevator even though the emergency power supply supplies power to some of the elevator components.

Preferably, the elevator further comprises a safety chain which is connected with a safety chain input of the motor drive unit wherein the emergency power supply comprises a safety chain voltage output which provides a safety chain voltage to the safety chain input of the motor drive unit via the emergency drive switch. The safety chain typically comprises a plurality of safety contacts like door contacts, etc., which are arranged in series with each other. The safety chain insures that the elevator drive motor is operated only if all safety contacts are closed, i.e. if the elevator is in a safe condition. In case of a power failure the power supply for the safety chain is also interrupted. Accordingly, no voltage is applied to the safety chain input of the motor drive unit. In order to allow the motor drive unit to drive the drive motor in a rescue mode it is necessary to provide the safety chain input of the motor drive unit with a "faked" safety chain voltage. Such voltage can be provided by the emergency power supply as well. The safety chain voltage typically is between the higher and the lower voltages, for example 48 V DC and 110 V AC, respectively. Alternatively the emergency power supply may supply its power to the input of the safety chain. In this case all the safety chain contacts need to be closed in order to allow movement of the elevator car even in a rescue mode.

Preferably the motor drive unit further comprises a control input which is connected via the emergency drive switch to a voltage output of the emergency power supply wherein the motor drive unit is designed to provide to the drive motor with a power supply according to an emergency rescue mode, if a pre-determined voltage output is applied to its control input. In normal operation the motor drive unit receives control signals through its control input from the elevator control. Since in the rescue mode, however, the elevator control typically is out of service, an emergency rescue mode signal needs to be generated and supplied to the control input of the motor drive unit. Preferably the pre-determined voltage corresponds to the lower voltage output of the emergency power supply. This construction makes a separate emergency elevator control superfluous.

Preferably the elevator further comprises a door zone indicating device wherein that door zone indicating device is connected to the elevator rescue system for stopping the car at a landing once the door zone indicating device has signaled that the car is positioned at a landing. The door zone indicating device is a common component in the elevator and is necessary for proper operation of the elevator. Typically the door zone indicating device signals approaching a landing and leveling at a landing. In order to insure correct positioning of the elevator car at a landing even in case of a rescue operation, the door zone indicating device is used in the elevator rescue system. Preferably the door zone indicating device stops the car at the next landing where the elevator door can be opened manually by the person operating the rescue system or automatically by the elevator rescue system.

Preferably the elevator further comprises a speed control unit for controlling the speed of the car, wherein the speed control unit is connected to the elevator rescue system and particularly to the brake.

Embodiments if the invention are described below in greater detail with reference to the Figures, wherein:

DETAILED DESCRIPTION OF THE PREFERRED EMBODIMENT

Figure 1:
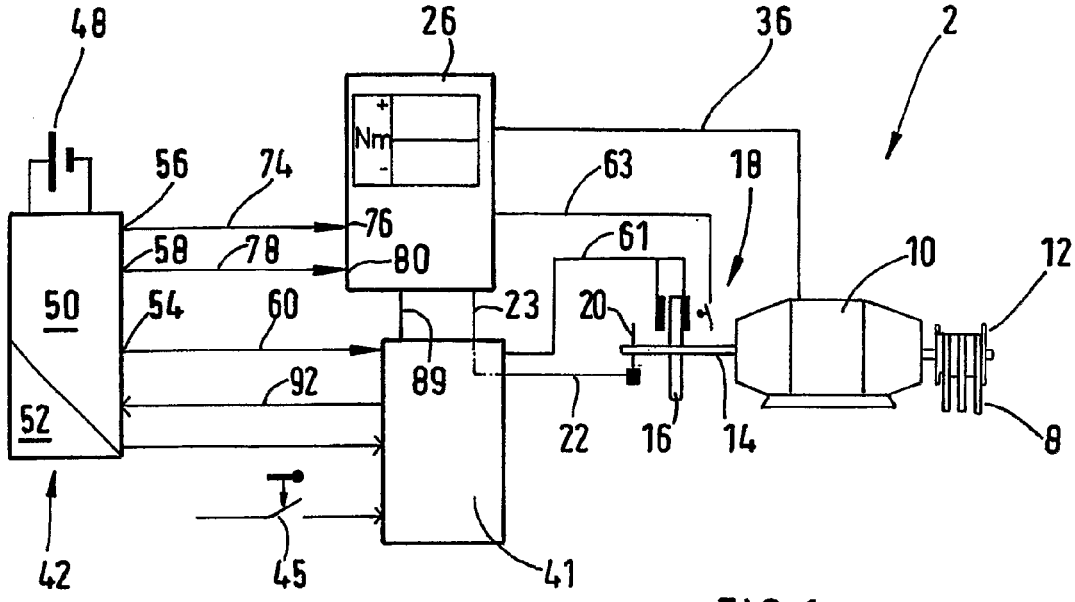
FIG. 1 is a schematic view of parts of the elevator in accordance with a first embodiment of the present invention.
Figure 2:
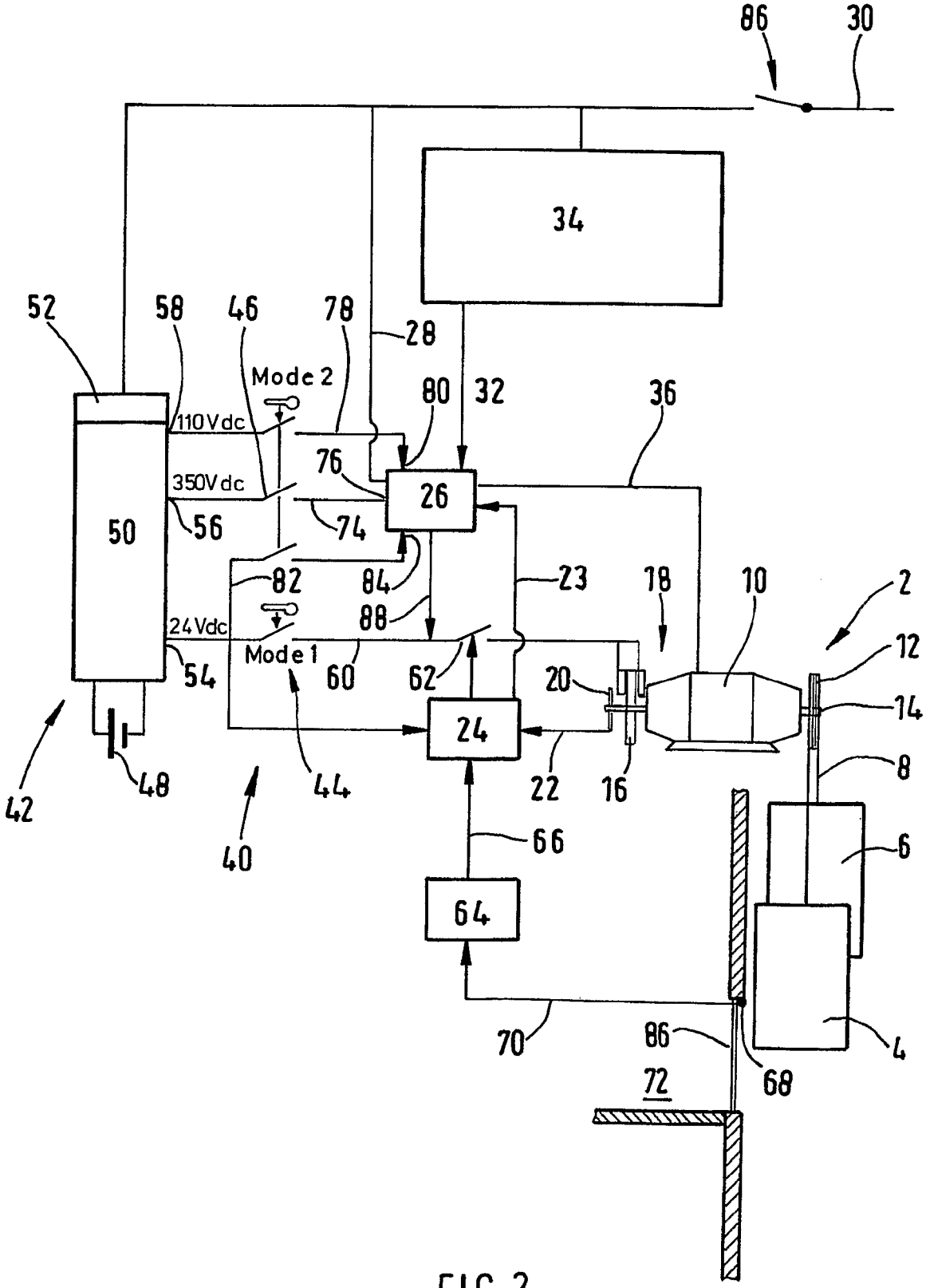
FIG. 2 is a schematic view of an elevator in accordance with a second embodiment of the present invention with more detail.

FIGS. 1 and 2 show similar embodiments of the present invention. Corresponding reference numerals in the Figures refer to similar elements throughout the individual Figures.

FIG. 1 shows part of an elevator 2 comprising a hoisting rope 8 driven by drive motor 10 via a traction sheave 12. Preferably, the hoisting ropes are coated steel belts. Attached to the shaft 14 of the drive motor 10 is a brake disk 16 of a break 18. Also attached to shaft 14 is an encoder wheel 20 providing encoder or speed control information via line 22 to a service panel board 41 and through the service panel board 41 to a motor drive unit 26. The motor drive unit 26 supplies the required power to drive motor 10 through line 36. The motor drive unit 26 can be of the type as will be described subsequently with respect to FIG. 2.

The elevator 2 further comprises an elevator control, a main power supply, etc. as will be discussed subsequently with respect to FIG. 2. The elevator 2 also comprises an emergency power supply 42 and an emergency brake switch 44.

The emergency power supply 42 includes a storage battery 48, a voltage booster 50 and a battery loading and supervising circuit 52. The emergency power supply provides three different output voltages, i.e. a lower voltage to voltage output 54, a higher voltage to output 56, and an intermediate voltage to output 58. Depending on the particular elevator, the voltage values may vary.

However, typical voltage values are 24 V DC for lifting the brake and for supplying the electric control devices like speed control, etc., 110 V as this is the typical voltage used for the elevator safety chain, and 350 V DC for supplying the motor drive unit 26 and eventually the drive motor 10. The latter voltage depends on the particular construction of the motor drive unit 26. Typically such a motor drive unit 26 requires a minimum input voltage even though the output voltage to the drive motor 10 will typically be far less in a balanced load emergency operation mode.

The lower voltage is supplied through line 60 to the service panel board 41 and can be distributed from there to lift the brake 18 either through line 61 connecting the service panel board 41 with brake 18 or through line 63 connecting the motor drive unit with brake 18. In the latter case the motor drive unit 26 can control brake 18. It is possible to have only one of lines 61 and 63 instead of both lines. Line 89 is supplying low voltage from service panel board 41 to motor drive unit 26 and/or communication information between service panel board 41 and motor drive unit 26.

It is to be noted that in accordance with an embodiment of the present invention as shown in FIGS. 1 and 2 a single encoder 20 is used instead of two encoders. Particularly, with the prior art a main encoder and additionally thereto a rescue encoder are present and the encoder information of the main encoder which is directly provided to drive unit 26 is used in case of normal operation, while the encoder information of the rescue encoder 20 which is provided to the service panel board 21 is used in case of rescue operation only. As the main encoder and the rescue encoder are of different types, i.e. high cost, high resolution, main encoder (approx. 1000-4000 pulses/revolution) and low cost, low resolution rescue encoder (approx. 50-100 pulses/revolution), it is not possible to use the rescue encoder as a redundancy or backup encoder for the main encoder. Thus, in accordance with an embodiment of the present invention only a single high resolution type encoder is used providing its information to the motor drive unit 26 via surface panel board 41.

The motor drive unit 26 is of the type capable of determining the movement condition of the elevator car, i.e. position, direction of movement, speed, and/or acceleration of the car, on the basis of power data as obtained from the motor 10 in generator mode and/or provided to motor 10 in active drive mode. It is to be noted that exemplary power data are voltage, current, frequency, etc.

This type of motor drive unit 26 can also be used as a redundancy for providing encoder and/or speed information in case of a main encoder failure. Thus it is possible to at least continue the travel of the elevator car to the next landing in case of an encoder failure.

Encoder 20 can be connected to a separate speed control 27 as will be shown in FIG. 2. Such speed control can, however, be incorporated in the service panel board 41 and/or the motor drive unit 26.

The emergency power supply 42 can be connected with the main power supply during normal operation so that optimum charge condition of the storage battery 48 can be maintained.

FIG. 2 shows an elevator 2 comprising a car 4 and a counterweight 6. The car 4 and the counterweight 6 are suspended by a hoisting rope 8. The hoisting rope 8 is driven by a drive motor 10 via a traction sheave 12. Attached to the shaft 14 of the drive motor 10 is a brake disc 16 of a brake 18. Also attached to shaft 14 is an encoder wheel 20 providing speed control information via line 22 to a speed control 24.

A motor drive unit 26 is connected with the main power supply 30 of the elevator 2 through line 28 and receives control signals from an elevator control 34 through line 32. In accordance with the control signals of the elevator control 34 the motor drive unit 26 supplies the required power to the drive motor 10 through line 36. Particularly the motor drive unit 26 comprises a rectifier for rectifying the AC current received through line 28, an intermediate DC circuit and an VVVF inverter (Variable Voltage Variable Frequency). The VVVF inverter varies the voltage and frequency output through line 36 to the drive motor 12 in accordance with the control signals of the elevator control 34.

The elevator 2 further comprises an elevator rescue system 40 which is formed of conventional components of the elevator system, i.e. the motor drive unit 26 and the speed control 24, on the one hand, and of additional components which are specific to the elevator rescue system 40. Such additional components comprise the emergency power supply 42, the emergency brake switch 44 and the emergency drive switch 46.

The lower voltage from the emergency power supply 42 is supplied through line 60 and the emergency brake switch 44 through the solenoid (not shown) of the brake 18. A speed control switch 62 is provided in line 60. The speed control switch 62 is controlled by the speed control 24. The latter receives its information about the speed of the elevator car via line 22 from the encoder wheel 20. The speed control 24 further receives information from a door zone indicator (DZI) 64 via line 66. The door zone indicator 64 is connected with a door zone sensor 68 via line 70. The door zone sensor 68 signals to the speed control 24, once the elevator car approaches and reaches a landing 72. Accordingly, the speed control can interrupt the power supply to the brake 18 in case of overspeed of the elevator car 4 or if the elevator car 4 has reached a landing 72.

The higher voltage is supplied from output 56 through line 74 to the power input 76 of motor drive unit 26. Emergency drive switch 46 is located in line 74. The intermediate voltage is supplied through line 78 from output 58 to safety chain input 80 of the motor drive unit 26. Moreover, the lower voltage from output 54 is connected via line 82 through the control signal input 84 of the motor drive unit 26.

The emergency drive switch 46 actually comprises three switches in lines 82, 74 and 78. Accordingly, the emergency drive switch 46 jointly switches the low, the intermediate and the higher voltages to the motor drive unit 26. However, there is no need to jointly switch the voltages to the motor drive unit 26. Accordingly, it is possible to have three individual switches instead of the common emergency drive switch 46.

The elevator 2 further comprises a main power switch 86 which is located in the main power supply line 30. It is preferred to disconnect the main power supply from the elevator 2 before initiating an emergency drive mode of operation in order to assure well defined operating conditions even if during emergency mode the main power supply may be reestablished. Preferably the main power switch 86 is connected—mechanically or electronically—with the emergency drive switch 46 and/or the emergency brake switch 44. In this context it is to be noted that only a fraction of the connections between the main power supply line 30, the elevator control 34 and the individual elevator component is shown in the drawing for clarity. For example, the drawing does not show the safety chain which typically is connected to the elevator control 34. The main focus of FIG. 1 is on the emergency rescue system and the elevator components embedded therein.

The switches 44, 46 and 86 are preferably located at a convenient position next to the elevator 2, for example integrated in a control panel (not shown). The switches can also be located remote from the elevator 2 proper, for example in a building control room, etc.

It is to be noted that similar to FIG. 1, FIG. 2 is very schematic and particularly shows a variety of separate controls, switches, etc. which all or some thereof could be integrated in the motor drive unit 26. Particularly, the speed control 24, the speed control switch 62 and/or the door zone indicator 64 could as well be part of the motor drive unit 26. It might also be possible to incorporate the emergency brake switch 44 into the motor drive unit 26. In this case a single manually operated switch like switch 46 can be sufficient to energize the motor drive unit and to start the emergency operation which is governed and controlled by the motor drive unit, as it is shown in FIG. 1.

The operation of the elevator 2 of FIG. 2 in an emergency situation can be as follows:

Mode 1 (This Method is not in Accordance with the Present Invention But can be Used as a Backup Method, for Example in Case of Failure of the Motor Drive Unit 26):

After an elevator failure has been detected, the technician or any other qualified person switches switch 44, thus supplying the lower voltage to brake 18 and lifting the brake. If the elevator 2 is in an unbalanced condition, the elevator car and counterweight 4 and 6, respectively, will start moving. The speed control 24 monitors the speed of the elevator car 4 and stops the car 4 if an overspeed condition occurs. Eventually, the sensor 68 will sense that the elevator car 4 is within a door zone, transmits a respective signal through line 70 to the door zone indicator 64 and interrupts the power supply via the speed control 24 and speed control switch 62 to the brake 18. Accordingly, the elevator car 4 will stop at landing 72. The qualified person can then manually open the elevator shaft door 86 and the elevator car door. If the car 4 is not moving within a fixed period of time, the emergency brake switch 44 can be closed. In this case the mode 1 rescue operation can be re-tried one or two (or even several) times.

Mode 2:

In mode 2 rescue operation the operator or any automatic rescue control like the motor drive unit 26 switches the emergency drive switch 46, thus switching to the motor drive unit 26 the low, intermediate and higher voltages. The low voltage received through control input 84 signals to the motor drive unit 26 a rescue drive mode, i.e. low power, low speed, etc., and the motor drive unit 26 will start to operate in the zero speed demand mode. Subsequently, the low voltage is supplied through line 88 to brake 18 and lifts the brake. Accordingly, no mechanical coupling of the emergency brake switch 44 and the emergency drive switch 46 is required. The intermediate voltage "fakes" at the safety chain input 80 a positive safety chain signal, i.e. the motor drive unit 26 obtains a signal as if the safety chain (not shown) is properly working and signals that all safety chain contacts are closed. The motor drive unit 26 further receives the higher voltage through input 76 and, accordingly, supplies the drive voltage through line 36 to drive motor 10 as required for holding the car 4 at its position. Once the motor drive unit has determined the load/movement condition of the car 4, the motor drive unit 26 will start the rescue run and the drive motor 10 will slowly move or allow movement of the elevator car 4 in the preferred movement direction until the sensor 68 signals to the door zone indicator 64 that the elevator car 4 has reached a landing 72. If so, the speed control 24 will trigger brake 18 and stop the car 4 at the landing 72. The operator may then manually open the emergency drive switch 46. Alternatively, there is an automatic system for resetting the emergency drive switch 46. The operator can open the elevator door at landing 72 allowing the trapped persons to leave the elevator car 4. The doors can also be opened automatically.

The operation of the elevator 2 of FIG. 1 is similar to the operation of elevator 2 of FIG. 2. The main difference is that with the embodiment of FIG. 1 the so-called brake release button ("BRB") starts the rescue run sequence. Similarly, the elements and functions of the embodiments of FIGS. 1 and 2 are relatively similar so that elements and functions which are described with respect to any of the Figures are likewise applicable to the other Figure as well, unless the particular combination is in clear contradiction to the remainder of this embodiment.

Figure 3:
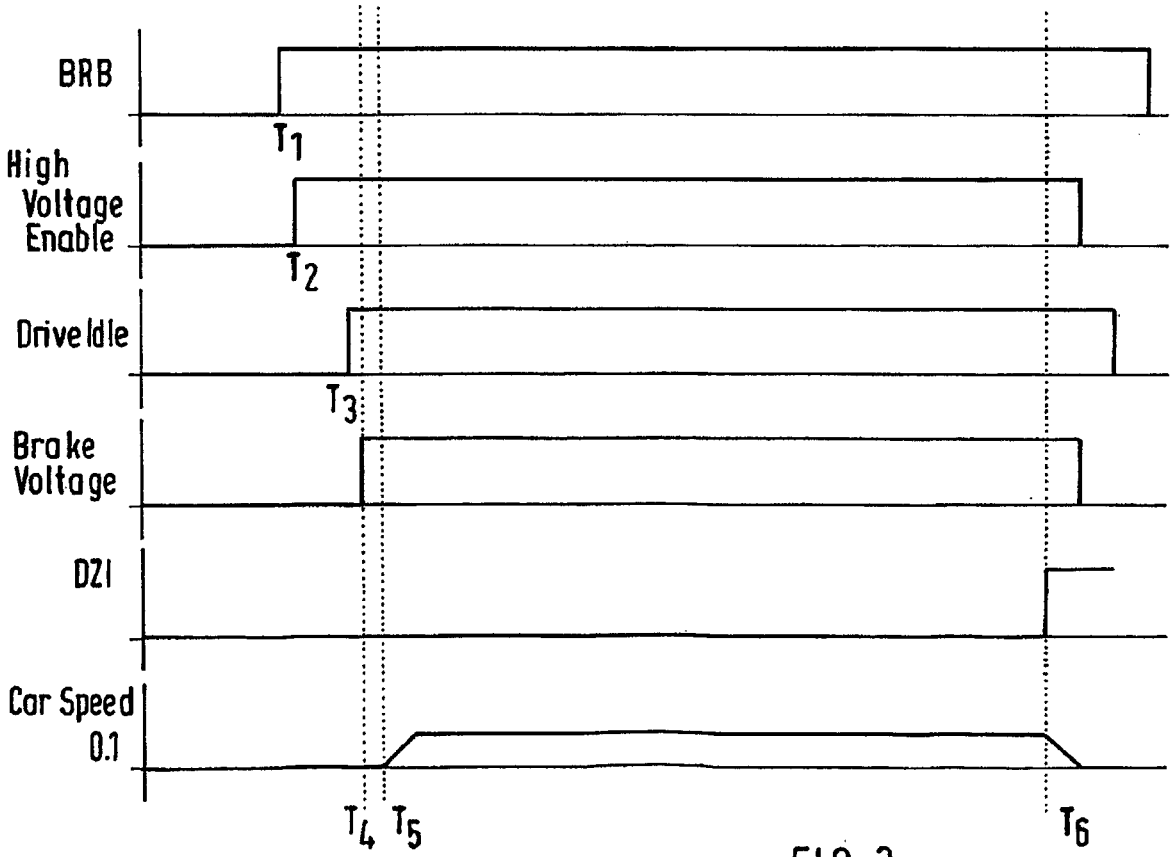
FIG. 3 is a timing diagram for an embodiment of the present invention.

As can be seen in FIG. 1, low voltage is provided to the service panel board through line 60. There can be a continuous connection so that the service panel board 41 continuously receives low voltage through line 60 from the emergency power supply 42. Once an emergency has been detected and the car 4 is stopped in the elevator shaft, a brake release button 45 is switched and generates a brake release button signal as indicated in the top line of FIG. 3. Subsequently, the service panel board 41 generates a high voltage enable signal through line 92 to the emergency power supply 42 resulting in providing high and/or immediate power through lines 74 and 78, respectively, to the motor drive unit 26. Accordingly, some or all emergency power switches may also be integrated with the emergency power supply 42. The motor drive unit 26 generates a drive idle signal at time $T_3$ while the car speed is set to "0", as can be seen in the last line of FIG. 3. Subsequently, a brake opening voltage is supplied through line 61 and/or line 63 to brake 18 at time $T_4$ and the brake is opened so that the car is held by drive motor 10 which is controlled by the motor drive unit 26 in the zero speed mode.

The motor drive unit 26 is operated in the zero speed demand mode between time $T_4$ and time $T_5$, during which time the motor drive unit 26 can determine the preferred movement direction of the car 4 from power data as obtained/received from the drive motor 10 during this time period and/or power data as stored in the motor drive unit 26. Subsequently the car speed is slowly accelerated and subsequently held at a predetermined, typically relatively slow level until the door zone indicator "DZI" indicates at time $T_6$ approach to a landing, thereupon the car speed is gradually reduced and the brake release power is shut off so that the car 4 is stopped at the landing. Approximately at the same time the high voltage enable signal is turned off so that subsequently the drive idle signal to the motor drive unit 26 terminates. Finally the signal as provided by the brake release button 45 is stopped.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The invention claimed is:

1. A method for performing an elevator rescue run in an emergency situation, the elevator comprising an elevator car, a counter weight, a rope suspending the car and the counterweight, a drive motor, an emergency break for stopping the car in an emergency situation, and a motor drive unit for supplying drive power to and for controlling the drive motor, comprising the steps of:

(a) operating the motor drive unit in a zero speed demand mode for holding the car at its present position;

(b) lifting the emergency brake, while holding the car in the zero speed demand mode;

(c) determining a preferred movement direction of the car based on the power data as obtained by the motor drive unit; and (d) performing the rescue run in the direction of the determined preferred movement direction.

2. The method according to claim 1, further comprising the step of supplying power from an emergency power supply to the motor drive unit.

3. The method according to claim 1, wherein the motor drive unit controls the performance of the rescue run.

4. The method according to claim 1, wherein the motor drive unit activates the emergency brake to open after the zero speed demand operation has been established.

5. The method according to claim 1, wherein the motor drive unit activates the performance of the rescue run, once the preferred movement direction of the car has been determined.

6. The method according to claim 1, wherein the rescue run sequence is automatically started once an emergency situation is detected.

7. The method according to claim 6, further comprising the step of surveilling the presence of main power supply to the elevator and automatically starting the rescue run sequence once a main power failure has been detected.

8. The method according to claim 7, further comprising the step of interrupting the main power supply to the motor drive unit when the rescue run sequence is started and at least until the rescue run is completed.

9. The method according to claim 1, wherein the motor drive unit supplies power to the drive motor during the step of performing the rescue run.

10. The method according to claim 1, wherein the elevator comprises a rescue drive separate from the drive motor and wherein the motor drive unit activates said rescue drive once the preferred movement direction of the car has been determined.

11. An elevator comprising:

an elevator car;

a counterweight;

a rope suspending the car and the counterweight;

a drive motor;

an emergency break for stopping the car in an emergency situation; and a motor drive unit for supplying drive power to and for controlling the drive motor; and wherein the motor drive unit is adapted to operate in a zero speed demand mode for holding the car at a particular position and to determine the preferred movement direction of the car based on the power data as obtained by the motor drive unit while holding the car in the zero speed demand mode, and wherein the elevator further comprises a means for setting the motor drive unit into the zero speed demand mode in case of an emergency situation in preparation of a rescue run and for subsequently activating performance of the rescue run in the direction of the determined preferred movement direction.

12. The elevator according to claim 11, further comprising and emergency power supply.

13. The elevator according to claim 11, further comprising a means for detecting an emergency situation and a means automatically starting a rescue run sequence once an emergency situation has been detected.

14. The elevator according to claim 13, wherein the detecting means is a main power surveilling means.

15. The elevator according to claim 14, further comprising a main power interrupting means coupled to the main power surveilling means.

16. The elevator according to claim 11, further comprising a rescue drive means separate from the drive motor.

* * * * *

UNITED STATES PATENT AND TRADEMARK OFFICE

CERTIFICATE OF CORRECTION

PATENT NO. : 7,681,693 B2
APPLICATION NO. : 11/813238
DATED : March 23, 2010
INVENTOR(S) : Tegtmeier et al.

It is certified that error appears in the above-identified patent and that said Letters Patent is hereby corrected as shown below:

Claim 12, column 13, line 14: "and" should read as --an--

Signed and Sealed this

Twenty-second Day of June, 2010

David J. Kappos

David J. Kappos
*Director of the United States Patent and Trademark Office*